United States Patent [19]

Ravey

[11] 4,125,833

[45] Nov. 14, 1978

[54] SEQUENCE SWITCHING CIRCUIT WITH LATCHING ALARM

[76] Inventor: Donald L. Ravey, 127 Chukker Ct., San Mateo, Calif. 94403

[21] Appl. No.: 735,188

[22] Filed: Oct. 26, 1976

[51] Int. Cl.[2] ..... E05B 45/06; G08B 29/00

[52] U.S. Cl. ..... 340/542; 340/63; 340/164 R; 340/523; 340/543; 361/171

[58] Field of Search ..... 340/274 C, 274, 63, 340/64, 164 R, 223, 542, 543, 523; 361/171, 166; 307/10 AT; 70/286, 333 R

[56] References Cited

U.S. PATENT DOCUMENTS

| | | | |
|---|---|---|---|
| 2,819,770 | 1/1958 | Gibbs | 340/64 |
| 2,843,843 | 7/1958 | Davis | 340/63 |
| 3,392,558 | 7/1968 | Hedin et al. | 340/274 C |
| 3,453,591 | 7/1969 | Perez | 340/64 |
| 3,587,950 | 6/1971 | Haish | 340/64 |
| 3,609,738 | 9/1971 | Marte | 340/274 |
| 3,611,287 | 10/1971 | Hoff | 340/63 |
| 3,710,316 | 1/1973 | Kromer | 340/63 |
| 3,731,156 | 5/1973 | Watson | 317/134 |
| 3,756,341 | 9/1973 | Tonkowich et al. | 180/114 |
| 3,790,933 | 2/1974 | Cort | 340/63 |
| 3,858,193 | 12/1974 | Bach | 340/274 |

*Primary Examiner*—Donald J. Yosko
*Assistant Examiner*—Donnie L. Crosland
*Attorney, Agent, or Firm*—Phillips, Moore, Weissenberger, Lempio & Majestic

[57] ABSTRACT

A sequence switching circuit including a plurality of two state DPDT switches for controlling the coupling of an energy source to either an output terminal or an alarm terminal, said switching circuit including interconnection means between said plurality of switches for coupling said energy source to said output terminal upon the changing of the state of said switches in a predetermined sequence, and for coupling said source of energy to said alarm terminal upon the changing of the state of any switch in a sequence other than the predetermined sequence. Said switching circuit further includes means for continuing the coupling of the energy source to said alarm terminal once said coupling has begun until all said switches are returned to their original state, and further until override means are actuated. The switching circuit further includes means for altering said predetermined sequence in a simple and easy manner.

12 Claims, 3 Drawing Figures

SEQUENCE SWITCHING CIRCUIT WITH LATCHING ALARM

BACKGROUND OF THE INVENTION

1. Field of the Invention

The present invention relates in general to switching circuits and more specifically to a sequence switching circuit including means for indicating when the predetermined sequence for said switches has not been followed.

2. Description of the Prior Art

Although sequence switching circuits have been described in the prior art, none have been found that show circuits wherein the switches have been thrown in the proper sequence both to energize an output circuit and to thereafter de-energize it. Nor do any of the references show a circuit in which an alarm, energized by changing the state of one or more switches in a sequence other than the predetermined sequence, can be deactivated only by a certain combination of the switches themselves. Finally, no references were found that allowed for the changing of a predetermined switch squence to be enabled by changing merely a plug-in element or separate circuit interconnection board.

SUMMARY OF THE INVENTION

The present invention provides a means for interconnecting a plurality of switches in such a way that the switches must be caused to change state in a prescribed predetermined sequence before an output terminal may be energized by an energy source. If a switch is caused to change state that is not in the predetermined sequence, an alarm terminal is caused to be energized such that subsequent placing of all switches in the state needed to energize the output terminal will not be sufficient to energize that terminal, and further the alarm terminal will be continued to be energized until certain combination of the states of the switches is existing. Further, all switches are required to be caused to change state back to their original state in the reverse of the predetermined sequence to return the sequence switching circuit to its original state without again causing the energy source to be coupled to the alarm terminal. The sequence circuit is designed such that any number of switches can be included in this switch sequence, and such that the predetermined sequence can be easily modified.

Therefore, a prinicpal object of the present invention is to provide a sequence switching circuit including three or more double pole double throw switches interconnected such that all switches must be caused to change state in the proper sequence before an energy source is coupled to the output terminal of the circuit so that, for example, a measure of protection against unauthorized operation of the device coupled to the output terminal of said circuit may be maintained thereby.

Another object of the present invention is to provide a sequence switching circuit wherein the physical positioning of the switches may be varied to provide a high number of alternative arrangements.

A further object of the present invention is to provide a sequence switching circuit wherein the electrical components required are commonly available and relatively inexpensive and wherein no sophisticated power supply is required. A voltage source sufficient enough to operate the relay of the present invention and the external circuit connected to the output terminal is sufficient.

Another object of the present invention is to provide a sequence switching circuit wherein use of plug-in connectors or wiring boards is enabled such that modification of a given switch sequence can be performed easily thereby.

Broadly stated, the present invention is a sequence switching circuit including a plurality of two state DPDT switches for controlling the actuation of a given function if a predetermined switch sequence is performed, and for actuation of an alarm function if said predetermined switch sequence is not performed. This circuit includes a source of energy, an output terminal for connecting said switching circuit to the given function, and an alarm terminal for connecting the switching circuit to the alarm function. Interconnection means are also provided for the plurality of switches such that all switches must be caused to change state from an original state to an actuation state in the predetermined sequence to couple the energy source to the output terminal. The interconnection means further includes means for detecting if any switch is caused to change state in a sequence other than the predetermined sequence and including means for acting in response to this detection to cause the energy source to be coupled to the alarm terminal. Continuation means are provided for retaining the switching circuit in a condition wherein the energy source is coupled to the alarm terminal. This continuation means operates independently of any further switch state changes so long as any switch remains in an actuation state. Finally, means are included for disconnecting the energy source from the alarm terminal when all switches have been returned to their original state.

These and other objects and advantages of the present invention will become more clear upon reference to the accompanying drawings and the following description.

DESCRIPTION OF THE PREFERRED EMBODIMENT

Figure 1:
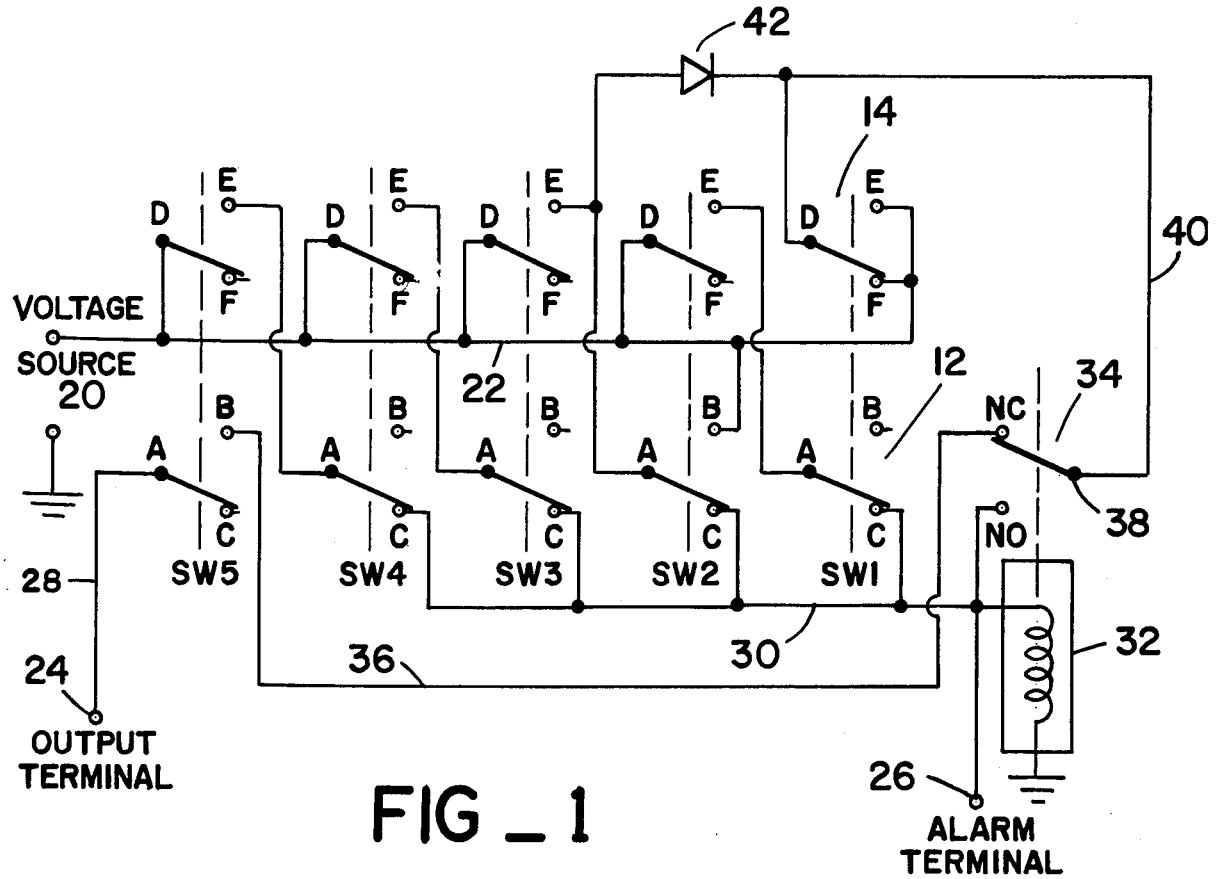
FIG. 1 is an electronic schematic illustrating the circuit components of the present invention.

A sequence switching circuit according to the present invention is illustrated in FIG. 1. The circuit of FIG. 1 shows a sequence switching circuit having five switches SW1-SW5, with each switch being a double pole double throw switch(DPDT). In other words, each switch includes two separate switch portions each having its own set of switch contacts or terminals. A double pole switch is defined to be a switch that operates simultaneously in two separate lines of an electrical circuit. Thus, a lower switch portion is shown at 12, and an upper switch portion is shown at 14 for switch SW1. The lower switch portion 12 includes a swing terminal A, a first terminal B, and a second terminal C. The upper switch portion 14 includes a swing terminal D, a first terminal E, and second terminal F.

The switches of the current invention have two operational states. These are defined to be an original state and an actuation state. In FIG. 1, the switches SW1-SW5 are shown in their original state, i.e. the switches are all in a downward position. When this state exists in a given switch, an interconnecting path is created between swing terminal A and second terminal C and between swing terminal D and second terminal F. When the switch is in its actuation state, an interconnection path exists between swing terminal A and first terminal B for the lower switch portion 12 and between swing terminal D and first terminal E for the upper switch portion 14.

Referring again to FIG. 1, an energy source comprising a voltage source 20 is coupled to the switches SW1-SW5 via a conductor 22. Also provided is an output terminal 24 and an alarm terminal 26. The sequence switching circuit is designed such that if all switches SW1-SW5 therein are caused to be changed from their original state to their actuation state correctly in a given predetermined sequence, the output terminal will have the voltage source coupled thereto via a switched path to be described hereinbelow. However, if any switch that is not part of the proper predetermined sequence is caused to change state from its original state to its actuation state, the voltage source is coupled to the alarm terminal 26, and no voltage is seen at the output terminal 24 until the voltage source 20 has been decoupled from the alarm terminal 26.

The sequence switching circuit of FIG. 1 is illustrated with all switches SW1-SW5 in their original state. Further, the switches are illustrated in the proper predetermined sequence such that the first switch required to have its state changed to an actuation state is switch SW1, and the last switch required to be changed to its actuation state is switch SW5. The output terminal of the sequence circuit is connected by a conductor 28 to the swing terminal A of the lower switch portion of SW5. When SW5 is in its original state, conductor 28 is coupled, via a switched path through switch SW5, to the second terminal C of the lower switch portion of that switch. This terminal is "open," in that no other connection is made to this terminal. The alarm terminal 26 is operatively connected to the sequence switching circuit by means of a trigger conductor 30. This trigger conductor 30 is tied to the second terminal C of the lower switch portion of all switches in the switch sequence except the last switch, which is switch SW5 in the present embodiment. The trigger conductor 30 is also connected to relay means comprising a relay energizing circuit 32 and to the normally open terminal of relay switch 34.

The trigger conductor 30 acts as means for detecting if any switch SW1-SW5 is caused to change state in a sequence other than the predetermined sequence. The relay means, in response to such a detection, comprises continuation means for retaining the switching circuit in a condition wherein the voltage source 20 is coupled to the alarm terminal 26. As will be described further herein, once the relay means has been actuated, these means operate independently of subsequent switch state changes so long as any switch remains in the actuation state.

Proper sequence switching operation disallows any coupling of the voltage source 20 to the trigger conductor 30. Note that with all switches SW1-SW5 in their original state, trigger conductor 30 is coupled via the lower switch portions of each of the switches SW1 through SW4 to the first terminal E of the upper switch portion of the next succeeding switch in the proper switch sequence. Thus, when the first switch in the switch sequence, SW1, is caused to be changed to its actuation state from its original state, the conducting path between the trigger conductor 30 and swing terminal A of the lower switch portion of switch SW1 is disconnected so that the trigger conductor 30 is no longer coupled to the first terminal E of the upper switch portion of switch SW2. Thus, when SW2 is caused to change to its actuation state, since it is the next switch in the predetermined sequence, the creation of a conducting path between the upper switch portion swing terminal D and the upper switch portion first terminal E of switch SW2 does not couple the voltage source 20 to trigger 30. If, however, SW1 was not in its actuation state when switch SW2 is caused to change state, since the voltage source 20 is coupled to the swing terminal D of SW2 via conductor 22, the source 20 is thereby coupled to the trigger conductor 30 via SW1 to trigger an alarm.

Similarly, if any of the other switches SW3-SW5 is caused to change state before SW1, a conducting path is created between the voltage source 20 and the first terminalE of that switch. Since SW1 is the switch required to change state first, by definition all the other switches are initially adjacent to a switch next preceding in the predetermined switch sequence that is still in its original state. Thus, a path is created between the first terminal of the switch improperly caused to change state and the trigger conductor 30 via the conducting path in lower switch portion of said next preceding switch. Therefore, the causing of any switch SW2-SW5 to be changed to its actuation state out of its proper sequence, i.e. if the next preceding switch has not already been caused to have its state changed to the actuation state, the voltage source 20 will be coupled therethrough to the trigger conductor 30. As mentioned above, this will cause the alarm terminal 26 to be energized by the voltage source 20.

From the above analysis, it is apparent that each one of the switches beginning first with SW1, then SW2 etc. must be changed from their original to their actuation state in order, otherwise the voltage source 20 will be coupled to the trigger conductor 30. When the switch sequence is complete and all switches have been properly changed to their actuation state, the lower switch portion of SW5 has the further function of coupling the voltage source 20 to the output terminal 24.

As can be seen, when switch SW5 is in its actuation state, the swing terminal A of the lower switch portion of this switch is coupled to its first terminal B. This first terminal B of switch SW5 is connected by means of a conductor 36 to the normally closed terminal of relay switch 34. Assuming that the switch sequence has been properly performed, the relay switch 34 remains in the normally closed state. With relay switch 34 in this state, conductor 36 is thereby coupled to the swing terminal D of the upper switch portion of switch SW1 via swing terminal 38 of the relay switch 34 and conductor 40. This swing terminal D of switch SW1 is normally continuously coupled to the voltage source 20 via conductor 22, since both the first and second terminals E and F of switch SW1 are tied in common to conductor 22. Thus, when all switches SW1-SW5 have been properly changed to their actuation state, the voltage source 20 is coupled to the output terminal 24 via switch SW1, relay switch 24, and switch SW5.

To disconnect the voltage source 20 from the output terminal 24, the reverse of the predetermined sequence must also be performed. Again, if it is not properly performed, the alarm terminal 26 will become energized from the voltage source 20. Note that the first switch to be changed back to its original state in the reverse of the predetermined sequence must be switch SW5 in the present embodiment. Switch SW5 also functions to decouple, at this first reverse sequence state change, the voltage source 20 from the output terminal 24. If switch SW5 is not the first to be returned to its original state but rather if any of the switches SW4–SW1 is caused to change state, a path between the voltage source 20 and the trigger conductor 30 will again be established such that the voltage source 20 will be coupled to the alarm terminal 26.

Assuming for example that switch SW3 is the first to be returned to its original state after all switches are in their actuation state, since switch SW4 would still be in its actuation state, the swing terminal A of the lower switch portion of switch SW3 would be coupled via the upper switch portion of switch SW4 to the voltage source 20. Thus, if switch SW3 is returned to its original state first, this voltage source appearing at the swing terminal A of SW3 would be coupled to the second terminal C of this switch. Since this terminal C is tied to trigger conductor 30, as described above, trigger conductor 30 would immediately be coupled to the voltage source 20 thereby.

A similar analysis to the above example can be made for all the switches that are not directly adjacent in switch sequence to the last switch that properly had its state changed. As another example, note that even if switches SW5 and SW4 are properly first returned to their original state in the proper order, if switch SW2 is next to be returned to its original state, again it will create a path for the voltage source 20 to the trigger conductor 30, as above, to indicate thereby an improper sequence.

Once an improper sequence has been detected by the sequence switching circuit of the present invention, two conditions result. First, no combination of switches will allow the coupling of voltage source 20 to the output terminal 24. Thus, for example, even if all switches were properly in their actuation state and voltage was properly appearing at the output terminal 24, if switch SW3 is caused to change state, even momentarily, back to its original state and then back to its actuation state again, the voltage source 20 would not be reconnected to the output terminal 24.

The second condition resulting from an improper sequence is that continuation means are provided to retain the switching circuit in a condition wherein the voltage source 20 is continued to be coupled to the alarm terminal 26, notwithstanding subsequent switch state changes. Only when a certain specific switch state change procedure has been operatively actuated does the voltage source 20 get decoupled from the alarm terminal 26.

The means for providing the continuation means and for decoupling power to the output terminal 24 when an improper switch sequence state change has been detected, comprises the relay means mentioned above. This means includes the relay energizing circuit 32 and the relay switch 34. Referring again to FIG. 1, it is seen that when the trigger conductor 30 has been coupled to the voltage source 20 as the result of detection of an improper switch sequence, conductor 30 both couples this voltage source 20 to the alarm terminal 26, and also couples it to the relay energizing circuit 32. This causes the relay means to actuate, thereby causing relay switch 34 to change state. When this occurs, a conducting path is formed between the swing terminal 38, and the normally open terminal of the relay switch 34. Since the normally open terminal of relay switch 34 is connected to trigger conductor 30 and therewith to the relay energizing circuit 32, so long as voltage from voltage source 20 appears at the swing terminal 38 of relay switch 34, the switch 34 will remain in this latched state. Further, relay switch 34 enables the continuing coupling of the voltage source 20 to the alarm terminal 26. In other words, the circuit is designed to latch the relay means when an improper sequence state change has been detected, to enable continued coupling of the voltage source 20 to alarm terminal 26. Note that in the present embodiment, the relay energizing circuit 32 comprises a standard relay coil.

With the relay switch 34 continuing to provide a conduction path between the swing terminal 38 and the normally open terminal of the relay switch 34 when the alarm terminal is energized, it is seen that the output terminal 24 has no opportunity to have the voltage source 20 coupled to its since conductor 36 now is not able to be connected via the relay switch 34, or by any other switch path, to the voltage source 20. Therefore, notwithstanding the states of either switch SW5 or any of the other switches, no means are provided for coupling the voltage source 20 to the output terminal 24 once the relay means has latched.

Only one specific means is provided for deenergizing the relay means of the present invention to thereby de-energize the alarm terminal. The upper switch portion 14 of switch SW1 is defined to include break before make means. That is, during a transition between either the original state and the actuation state, or vice versa between the actuation state and the original state, this upper switch portion 14 includes a transition point wherein neither the first nor the second terminal E or F has a conducting path to the swing terminal D of switch SW1. Thus, only at this point is the voltage source 20 not coupled via switch SW1 to the relay switch 34. To protect against having a multitude of possible switch states available to de-energize the relay means via this state change operation of switch SW1, a second voltage path is provided between the voltage source 20 and the relay switch 34 such that only when all the other switches SW2–SW5 are in a specific state, their original state in the present embodiment, will the transition of switch SW1 de-energize the relay energizing circuit 32 and thereby the relay means.

The circuit component added to provide this further continuation means comprises a diode operatively connected between the swing terminal A of the lower switch portion of the second switch in said predetermined sequence, switch SW2, and the swing terminal D of the upper switch portion of said first switch, switch SW1. This diode operates to enable the coupling of the signal appearing at the swing terminal A of the lower switch portion of switch SW2 to the relay switch 34. A diode is needed to prevent an erroneous improper sequence indication. This is because the voltage source 20 appears at swing terminal D of switch SW1. Diode 42 blocks this voltage from appearing back at swing terminal A of switch SW2, which is coupled to trigger conductor 20 when switch SW2 is in its original state.

A further conducting path is created between the first terminal B of the lower switch portion of switch SW2 and conductor 22. Thus, so long as switch SW2 is in its actuation state, the voltage source 20 via conductor 2 will be coupled to the relay switch 34 notwithstanding the states of any of the other switches SW3–SW5. Further, if switch SW2 is in its original state but any of the switches SW3-SW5 are not, this is a condition that is not within the proper predetermined sequence such that, as was explained above, the trigger conductor 30 will be coupled thereby through such improper switch state switch(es) to the voltage source 20.

In conclusion, therefore, only when switch SW2 is in its original state and all the other switches SW3-SW5 are also in their original state, will switch SW1 be free to have its transition detected by the relay switch 34 and the relay energizing circuit 32 to thereby decouple the voltage source 20 from the relay energizing circuit 32. Otherwise, if switch SW2 is not in its original state or if any one or more of the other switches, SW3 on in the predetermined sequence, are in the actuation state, the relay energizing circuit will remain coupled to the voltage source 20 and the alarm terminal will also remain energized.

Figure 2:
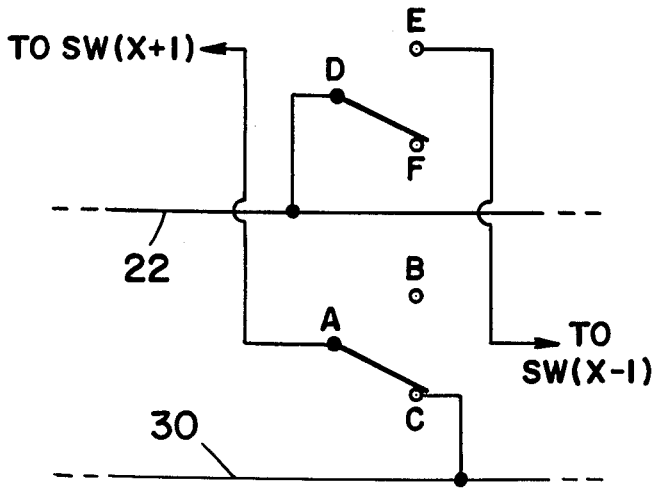
FIG. 2 illustrates a single switch "building block" useable to expand the number of switches in the sequence as desired.

Although the above discussion has involved the switching circuit illustrated in FIG. 1, which comprises five switches SW1–SW5, it should be appreciated that the present invention is applicable to any plurality of switches. In practice, less than three switches would not be of much use, however. FIG. 2 illustrates a switch "building block" for the present invention, showing how each switch is to be connected to the sequence switching circuit to expand the circuit shown in FIG. 1. As seen in FIG. 2, swing terminal A of an additional switch SWX needs to be connected to the first terminal E of the next succeeding switch, SW(X + 1) in the switch sequence. Swing terminal D of switch SWX is connected to conductor 22. The second terminal C is connected to conductor 30. Finally terminal E of switch SWX needs to be connected to the swing terminal A of the next preceding switch SW(X − 1) in the switch sequence. Such switch additions can be made at any point between switch SW2 and SW5. Also, the switching circuit of FIG. 1 can be reduced, clearly by simply eliminating switches SW3 and SW4 from the diagram. No change in operation characteristics occurs through adding or subtracting any number of switches to the sequence switching circuit.

Although the sequence switching circuit illustrated in FIG. 1 shows the predetermined sequence beginning at the right and going to the left in sequential order, the physical switch layout, in practice, can take any form. Thus, for example, the switches can be placed such that switch SW1 is next to switch SW4, switch SW3 next, etc. Also, one switch may be operable to the actuation state in an upward direction. The next switch may be operable to the actuation state by actuating the switch in a downward direction. Note also that the number of possible combinations available to a user of the present invention goes up both as the number of switches in the sequence goes up, and also goes up as a function of the number of switch orientations available. Such considerations are important especially if the present invention is used in security applications. Thus, if a six switch sequence is used, the probability of operating the sequence correctly the first time, without knowledge of the proper sequence, is over 1 in 720. If permutations are added through use of variations in switch physical orientation, for six switches, for example, over 40,000 additional permutations also known available.

Figure 3:
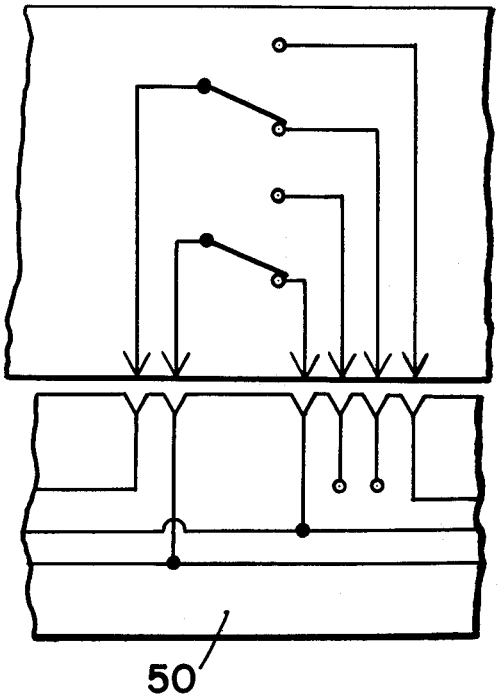
FIG. 3 illustrates a switch for the sequence switching circuit of the current invention configured to include plug-in circuit means.

FIG. 3 illustrates that the sequence switching circuit of the present invention further can comprise means for varying the predetermined sequence such that any desired switch sequence can be selectively chosen. A simple way of providing these means is to provide interchangeable plug-in cards such as printed circuit cards 50 having thereon all the interconnection paths for the number of switches in that particular sequence switching circuit. The only permanent wiring would therefore be simply the connecting of all of the switch terminals to the plug so that any given plug can connect up these switch terminal connections in any manner desired.

It is to be understood that the foregoing description is merely illustrative of a preferred embodiment of the invention and that the scope of the invention is not to be limited but is to be determined by the scope of the appended claims.

I claim:

1. A sequence switching circuit including a plurality of switches in combination with a source of energy for controlling the coupling of said source of energy either to an output terminal or to an alarm terminal as a function of the sequence of switch state changes, each said switch including an upper switch portion and a lower switch portion, each said upper and lower switch portion including a swing terminal and a first and second terminal, each said upper and lower switch portion having a conducting path between its said swing terminal and said second terminal when said switch portion is in an original state, and having a conducting path between its swing terminal and said first terminal when said switch portion is in an actuation state, said circuit comprising:

interconnection means between said plurality of switches for coupling said source of energy to said output terminal upon the changing of the state of said switches from said original state to said actuation state in a predetermined sequence, said switches including a first switch in said predetermined sequence, a last switch in said sequence, and a plurality of intermediate switches operatively positioned therebetween, and for coupling said source of energy to said alarm terminal upon the changing of the state of any said switch in a sequence other than the predetermined sequence, said means for coupling said energy source to said alarm terminal including:

(1) means for coupling said energy source to said upper swing terminal of each said intermediate switch and said last switch;

(2) means for enabling a conducting path from one of said upper terminals in each intermediate switch and said last switch to said alarm terminal, when such switches are in said original state, such that when any said switch is changed to its actuation state in any sequence other than the predetermined sequence, a conducting path is caused to be generated from said energy source to said alarm terminal;

(3) means for coupling said alarm terminal to one of said lower terminals of each said first and intermediate switch; and (4) means for enabling a conducting path from said lower swing terminal in each said first and intermediate switch to said energy source when such switches are in said actuation state as a function of said predetermined sequence, except when the switch was the last switch to be changed to an actuation state in said predetermined sequence, such that when any said switch is changed to its original state, a conducting path is caused to be generated from said energy source to said alarm terminal; and continuation means for retaining said switching circuit in a condition wherein said energy source is coupled to said alarm terminal.

2. The sequence switching circuit of claim 1 wherein:

said interconnection means further includes a conductor for connecting said swing terminal of said lower switch portion of said last switch to said output terminal, said first terminal of said lower switch portion of said last switch normally being coupled to said energy source via said first switch, such that when said first switch and each said intermediate switch is changed to an actuation state in said predetermined sequence, the switching of said last switch to its actuation state causes thereby said energy source to be coupled to said output terminal.

3. The sequence switching circuit of claim 1 further comprising means for overriding said continuation means for disconnecting said energy source from said alarm terminal, said means being operable only when all switches are returned to said original state.

4. The sequence switching circuit of claim 3 wherein said continuation means comprises a relay means operatively connected to said alarm terminal such that when said alarm terminal has said energy source coupled to it, said relay means acts in response thereto to continue thereafter to couple said energy source to said alarm terminal and to said relay means independently of switch state changes so long as any switch remains in said actuation state.

5. The sequence switching circuit of claim 4 wherein:

(1) said first switch includes break before make means in said upper switch portion, such that as said switch is in its transition from the actuation state to the original state or from the original state to the actuation state, no conduction path is created thereby from said upper switch portion swing terminal to the first terminal or the second terminal of that switch; and (2) said means for overriding said continuation means for disconnecting said alarm terminal from said energy source comprising a conductor operatively interconnecting said first switch break before make means between said energy source and said alarm terminal and said relay means, such that when said plurality of switches are all in their original state, the transition of the first switch from the actuation state to the original state or from the original state to the actuation state will cause thereby said energy source to be disconnected from said alarm terminal and said relay means, said relay means acting in response thereto to disconnect said alarm terminal from said energy source, such that when the first switch completes its state change, said energy source remains disconnected from said alarm terminal.

6. The sequence switching circuit of claim 5 wherein said relay means comprises:

a relay switch having a relay swing terminal, a normally closed terminal, and a normally open terminal; and a relay energizing circuit, such that when no energy source is applied to said circuit, a conducting path exists between said relay swing terminal and said normally closed terminal, and when an energy source is applied to said circuit, said relay switch is caused to change state such that said conducting path is changed from between the relay swing terminal and the normally closed terminal to between the relay swing terminal and the normally open terminal, said relay energizing circuit causing said relay switch to return to its original state wherein a conducting path is re-established between said relay swing terminal and the normally closed terminal of the relay switch when said energy source is decoupled from said relay energizing circuit.

7. The sequence switching circuit of claim 6 wherein said continuation means includes means for coupling said energy source to said relay swing terminal so long as said first switch is not in a transition between its original and actuation state, and if a transition of said first switch is occurring, so long as at least one of said plurality of switches other than said first switch is in the actuation state;

said normally closed terminal of said relay switch being connected to the first terminal of said lower switch portion of the last switch in said predetermined sequence such that so long as said relay means is not energized to thereby indicate an improper sequence, said energy source is coupled therethrough to said first terminal of said lower switch portion of said last switch such that when said predetermined sequence has been completed and said last switch has been changed to its actuation state, said energy source is coupled via said first terminal of said lower switch portion of said last switch to the swing terminal of said last switch lower switch portion to thereby couple said energy source to said output terminal;

said relay switch causing said energy source to be disconnected from said last switch when said relay means is actuated by an improper switch sequence, said energy source being coupled in response thereto from said relay swing terminal to said normally open terminal to couple thereby said energy source to said relay energizing circuit and said alarm terminal.

8. The sequence switching circuit of claim 7 wherein said continuation means further comprises a diode operatively connected between the swing terminal of the lower switch portion of the second switch in said predetermined sequence and the swing terminal of the upper switch portion of said first switch, and a conducting path between said first terminal of the lower switch portion of said second switch and said energy source, to enable said energy source be be coupled to said relay swing terminal independently of any said first switch transitions so long as at least one of said plurality of switches other than said first switch is in the actuation state.

9. The sequence switching circuit of claim 7 wherein said relay switch is operatively connected between said energy source and said last switch such that said energy source remains disconnected from said output terminal independently of the state of said plurality of switches until said energy source is caused to be disconnected from said relay energizing circuit.

10. The sequence switching circuit of claim 1 wherein said interconnection means further comprises means for detecting if any switch is caused to change state in a sequence other than the reverse of the predetermined sequence when said plurality of switches are being caused to change state from an actuation state back to their original state, said means acting in response to said detection means to cause said energy source to be coupled to said alarm terminal thereby.

11. The sequence switching circuit of claim 1 further comprising means for varying said predetermined sequence such that any desired switch sequence can be selectively chosen.

12. The sequence switching circuit of claim 11 wherein said means for varying the predetermined sequence comprises interchangeable plug-in means wherein all interconnection paths between said plurality of switches are made via said plug-in means.

* * * * *

UNITED STATES PATENT OFFICE

CERTIFICATE OF CORRECTION

Patent No. 4,125,833 Dated November 14, 1978

Inventor(s) DONALD L. RAVEY

It is certified that error appears in the above-identified patent and that said Letters Patent are hereby corrected as shown below:

| | |
|---|---|
| Column 1, line 50 | "prinicpal" should be --principal-- |
| Column 4, line 25 | "terminalE" should be --terminal E-- |
| Column 6, line 26 | "its" should be --it-- |
| Column 6, line 32 | "deenergizing" should be --de-energizing-- |
| Column 7, line 4 | "2" should be --22-- |
| Column 8, line 2 | "known" should be --become-- |
| Column 8, line 18 | "limited but" should be --limited thereto but-- |

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*